US011472611B1

(12) United States Patent
Hove

(10) Patent No.: US 11,472,611 B1
(45) Date of Patent: Oct. 18, 2022

(54) JAR LID WITH INTERNAL SCREW POUR SPOUT

(71) Applicant: Kyle Lee Hove, Cove, OR (US)

(72) Inventor: Kyle Lee Hove, Cove, OR (US)

( * ) Notice: Subject to any disclaimer, the term of this patent is extended or adjusted under 35 U.S.C. 154(b) by 236 days.

(21) Appl. No.: 16/863,776

(22) Filed: Apr. 30, 2020

Related U.S. Application Data

(60) Provisional application No. 62/965,636, filed on Jan. 24, 2020.

(51) Int. Cl.
*B65D 47/08* (2006.01)
*A47G 19/22* (2006.01)
*B65D 41/04* (2006.01)

(52) U.S. Cl.
CPC ..... *B65D 47/0885* (2013.01); *A47G 19/2272* (2013.01); *B65D 41/04* (2013.01); *B65D 47/0876* (2013.01); *B65D 2251/0003* (2013.01); *B65D 2251/0015* (2013.01); *B65D 2251/0078* (2013.01); *B65D 2251/08* (2013.01)

(58) Field of Classification Search
CPC ..... A47G 19/2272; B65D 47/0876; B65D 2251/0003; B65D 2251/0015; B65D 2251/0078
USPC ..... 220/254.3, 254.8, 259.2, 304, 844
See application file for complete search history.

(56) References Cited

U.S. PATENT DOCUMENTS

| | | | | |
|---|---|---|---|---|
| 2,142,636 | A * | 1/1939 | Evensen | B65D 51/04 220/291 |
| 2,147,246 | A * | 2/1939 | Dahl | B65D 35/42 220/291 |
| 5,921,431 | A * | 7/1999 | Pych | A47G 23/0241 215/393 |
| 7,299,955 | B2 * | 11/2007 | Pelkey | A47G 19/12 222/475.1 |
| 8,777,040 | B2 * | 7/2014 | Wahl | B65D 43/16 220/259.3 |
| 2011/0198352 | A1 * | 8/2011 | Lown | B65D 47/32 220/254.8 |
| 2020/0148430 | A1 * | 5/2020 | Cornelius | B65D 47/088 |

* cited by examiner

*Primary Examiner* — James N Smalley
(74) *Attorney, Agent, or Firm* — Plager Schack LLP; Maric H. Plager; Kara Verryt

(57) ABSTRACT

A pourable jar lid designed to removably engage with a jar, such as a mason jar, may include a lid body having a top surface and a lid lip extending away from the top surface, the lid lip having interior body threads thereon, wherein the interior body threads are designed to removably engage with threads on a neck of the jar; a pour spout extending upward from the top surface of the lid body, the pour spout including a raised wall defining a channel extending through the lid body, wherein an inner surface of pour spout has spout threads; and a pour spout cap hingeably attached to the top surface of the lid body, the pour spout cap including cap threads designed to removably engage with the spout threads, wherein the spout threads may have a thread gap therein.

6 Claims, 3 Drawing Sheets

JAR LID WITH INTERNAL SCREW POUR SPOUT

RELATED APPLICATION

This application claims priority to provisional patent application U.S. Ser. No. 62/965,636 filed on Jan. 24, 2020, the entire contents of which is herein incorporated by reference.

BACKGROUND

The embodiments described herein relate generally to containers and, more particularly, to a jar lid, such as a mason jar lid, with an internal screw pour spout.

Mason jar lids with a pour spout or flip top design typically do not seal well and can be unintentionally opened, causing spillage to occur. This is especially an issue with items that have pressure (e.g., carbonated products or other items than ferment and create a positive pressure in the jar). Having insufficient seals can allow oxygen into the interior of the jar, resulting in spoilage and spillage. Moreover, conventional mason jar lids do not provide for clean or easy pouring.

Therefore, what is needed is a mason jar lid with an internal screw pour spout that secures the contents with positive pressure, prevents or reduces the likelihood of leaks, and provides for a clean pour from the pour spout.

SUMMARY

Some embodiments of the present disclosure include a pourable jar lid designed to removably engage with a jar, such as a mason jar. The jar lid may include a lid body having a top surface and a lid lip extending away from the top surface, the lid lip having interior body threads thereon, wherein the interior body threads are designed to removably engage with threads on a neck of the jar; a pour spout extending upward from the top surface of the lid body, the pour spout including a raised wall defining a channel extending through the lid body, wherein an inner surface of pour spout has spout threads; and a pour spout cap hingeably attached to the top surface of the lid body, the pour spout cap including cap threads designed to removably engage with the spout threads, wherein the spout threads may have a thread gap therein.

BRIEF DESCRIPTION OF THE FIGURES

The detailed description of some embodiments of the invention is made below with reference to the accompanying figures, wherein like numerals represent corresponding parts of the figures.

DETAILED DESCRIPTION

Figure 1:
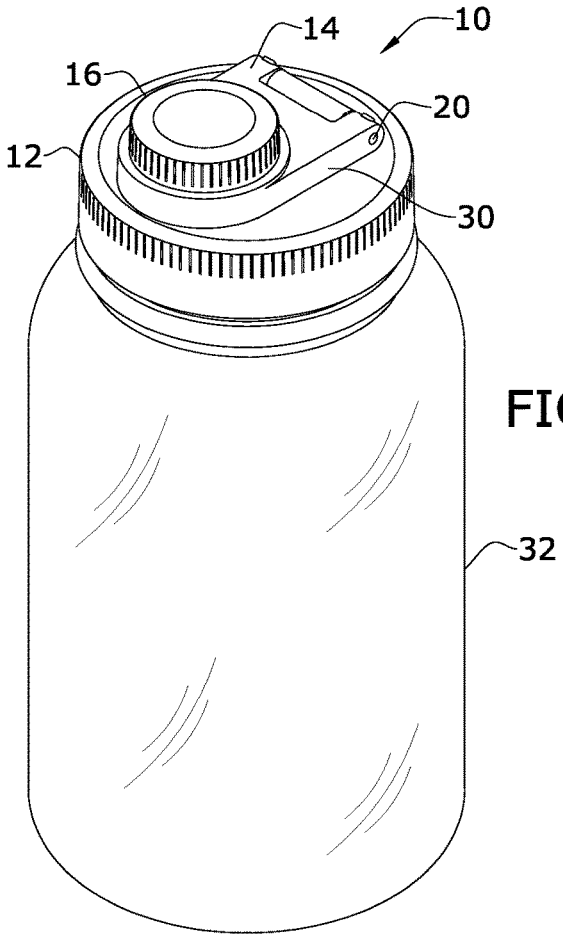
FIG. 1 is a perspective view of one embodiment of the present disclosure.
Figure 2:
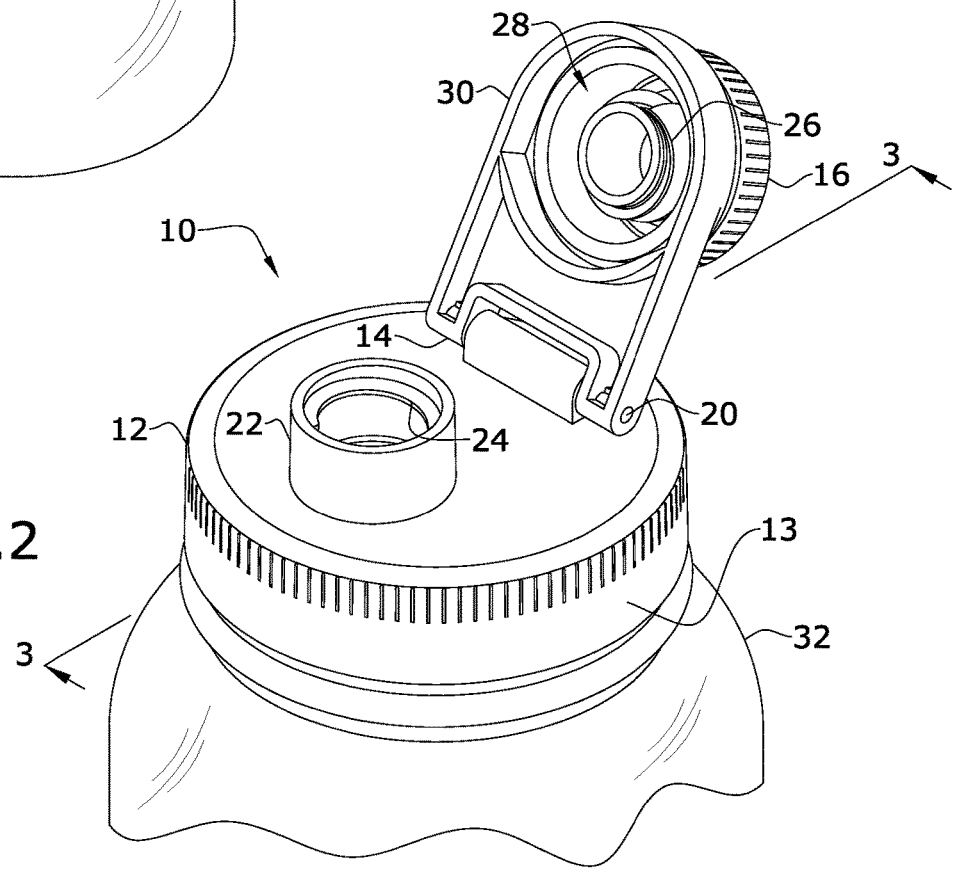
FIG. 2 is an enlarged perspective view of one embodiment of the present disclosure.
Figure 6:
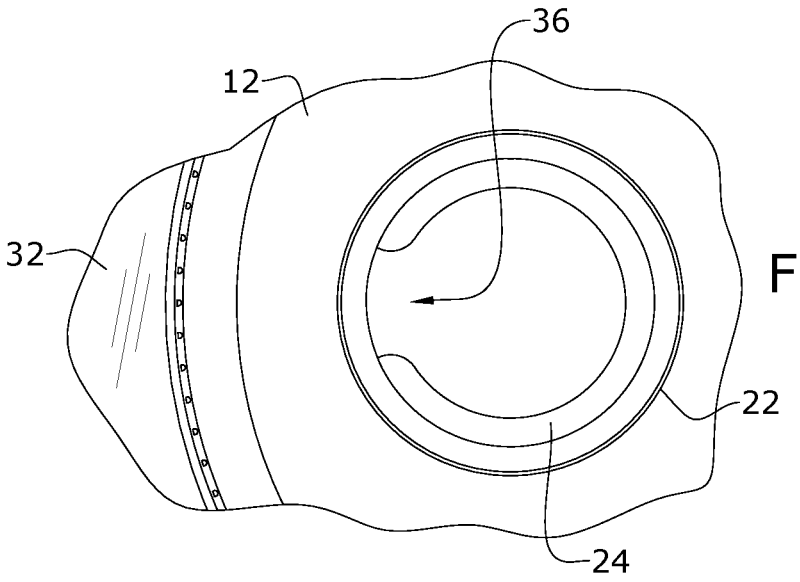
FIG. 6 is a top view of one embodiment of the present disclosure.

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used as a pourable jar lid and may comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

The various elements of the present disclosure may be related in the following exemplary fashion. It is not intended to limit the scope or nature of the relationships between the various elements and the following examples are presented as illustrative examples only.

By way of example, and referring to FIGS. 1-6, some embodiments of the invention include a pourable jar lid 10 designed to removably engage with ajar 32, such as a mason jar, the pourable jar lid 10 comprising a lid body 12 having a top surface and a lid lip 13 extending away from the top surface, the lid lip 13 having interior body threads thereon, wherein the interior body threads are designed to removably engage with threads on a neck of the jar 32; a pour spout 22 extending upward from the top surface of the lid body 12, the pour spout 22 comprising a raised wall defining a channel through which a liquid may flow from an interior of the jar 32 to an exterior of the jar 32, wherein an inner surface of pour spout 22 comprises spout threads 24; and a pour spout cap 16 hingeably attached to the top surface of the lid body 12, the pour spout cap 16 comprising cap threads 26 designed to removably engage with the spout threads 24. As shown in, for example, FIG. 6, some embodiments of the pourable jar lid 10 may include a thread gap 36 in the pour spout threads 24 for improved pouring. In other words, the pour spout threads 24 may not extend around the entire inner surface of the pour spout cap 16. As shown in the Figures, the thread gap 26 may be positioned distal from the hinge 14 ultimately connecting the cap 16 to the lid body 12.

For example, and as shown in the Figures, the pour spout cap 16 may include a cap extension protruding from a bottom surface thereof, wherein the bottom surface is the surface of the pour spout cap 16 that faces into the jar 32 when the pour spout cap 16 is engaged with the pour spout 22. The cap extension may be sized to fit within the pour spout 14, wherein the cap threads 26 may be on an exterior surface of the cap extension, such that the cap extension may engage with and secure within the pour spout 22 by rotating the cap 16, causing the cap threads 26 to engage with the spout threads 24. In embodiments, the cap extension may be concentrically positioned on the bottom surface of the pour spout cap 16 and spaced from the inner surface of the cap walls, thus creating a spout cavity 28 within the cap 16, wherein the spout cavity 28 is sized and positioned to accept the spout 22 therein when the cap threads 26 engage with the spout threads 24. In embodiments, both the cap threads 26 and the spout threads 24 may comprise threads that provide for two full turns of the cap 16 to completely engage the cap 16 with the pour spout 22.

Figure 3:
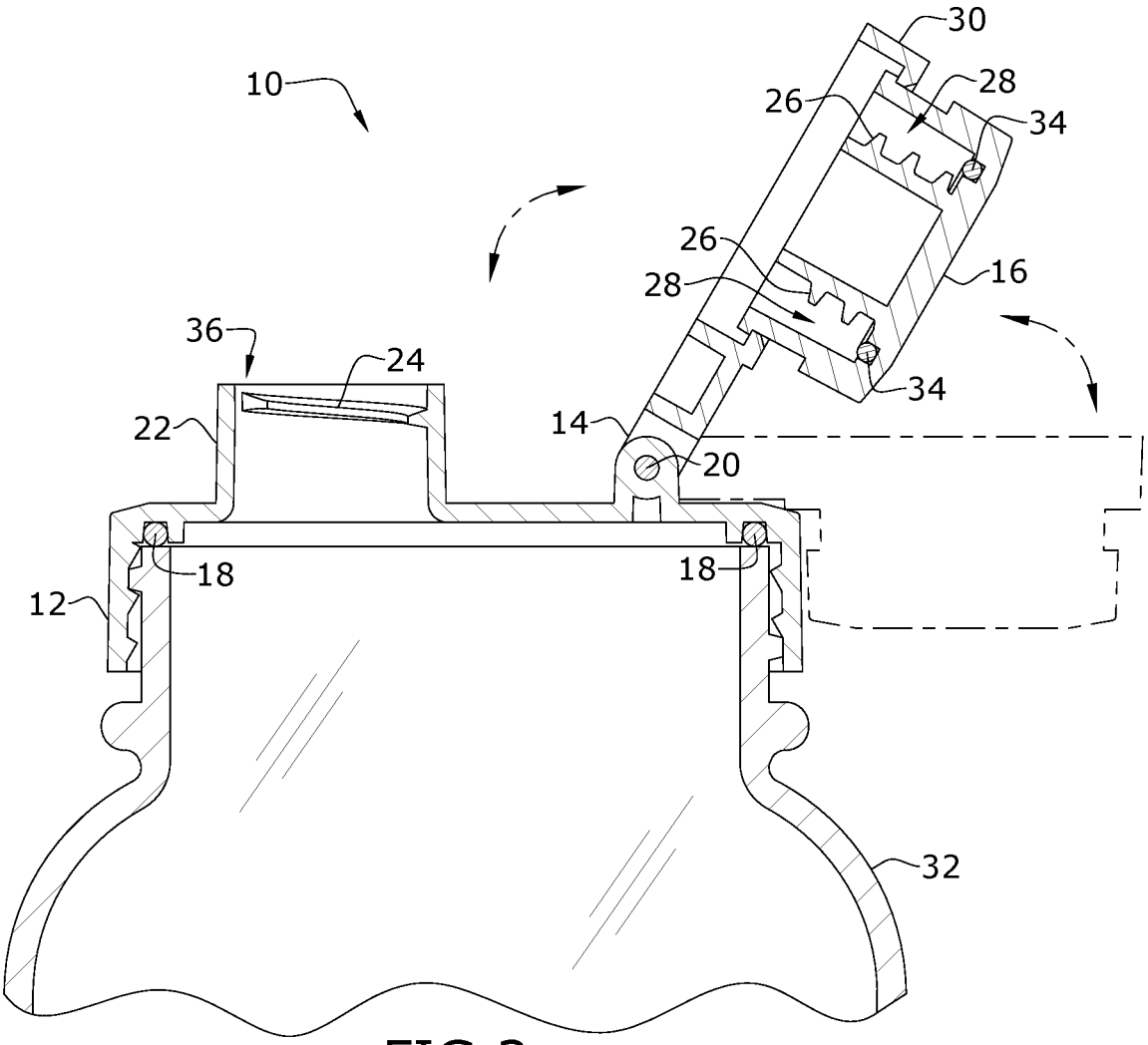
FIG. 3 is a section view of one embodiment of the present disclosure, taken along line 3-3 in FIG. 2.
Figure 4:
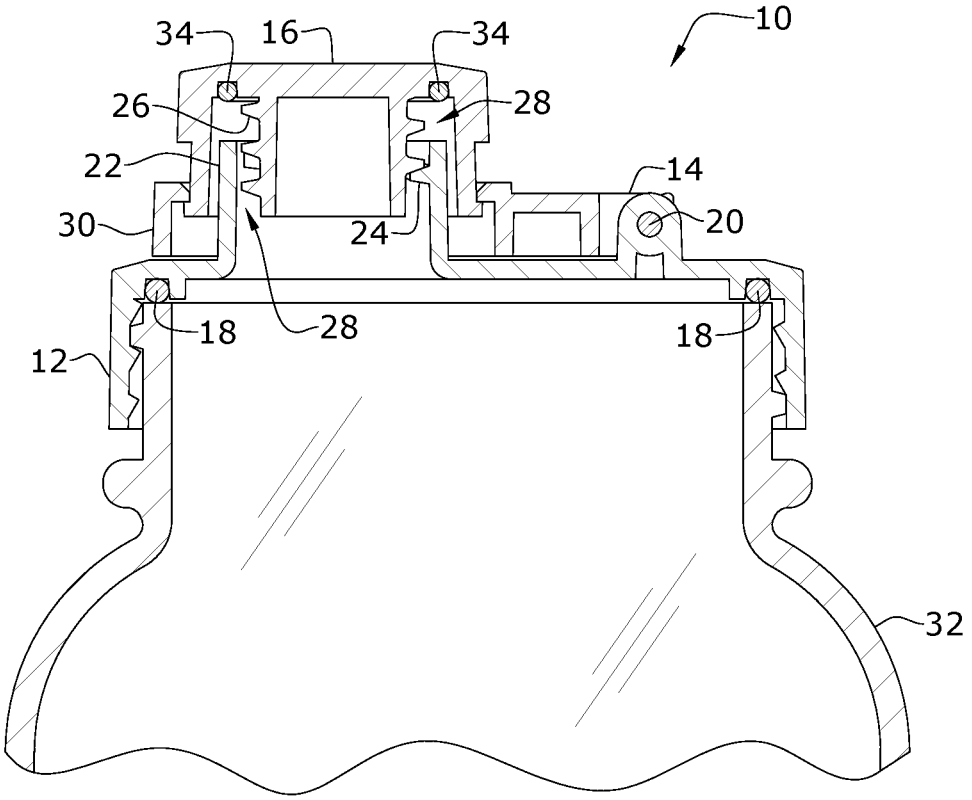
FIG. 4 is a section view of one embodiment of the present disclosure.

As shown in the Figures, the pour spout cap 16 may be operatively attached to a hinge 14 on a top surface of the lid body 12. For example, the pour spout cap 16 may be attached to an arm 30, wherein an end of the arm 30 distal from the pour spout cap 16 may hingeably attach to the top surface of the lid body 12. Particularly, the hinge 14 may include pin channel on the top surface of the lid body 12 and a pair of channel tabs on the distal end of the arm 30, wherein the channel tabs are spaced apart such that the pin channel may be positioned therebetween. A hinge pin 20 may extend through the tabs and the pin channel to hingeably attach the arm 30 to the top surface of the lid body 12, allowing the cap 16 to flip open 180° for drinking or pouring, as shown in FIG. 3. In embodiments, the hinge pin 20 may be knurled on one side to offer resistance to keep the hinge 14 open.

Figure 5:
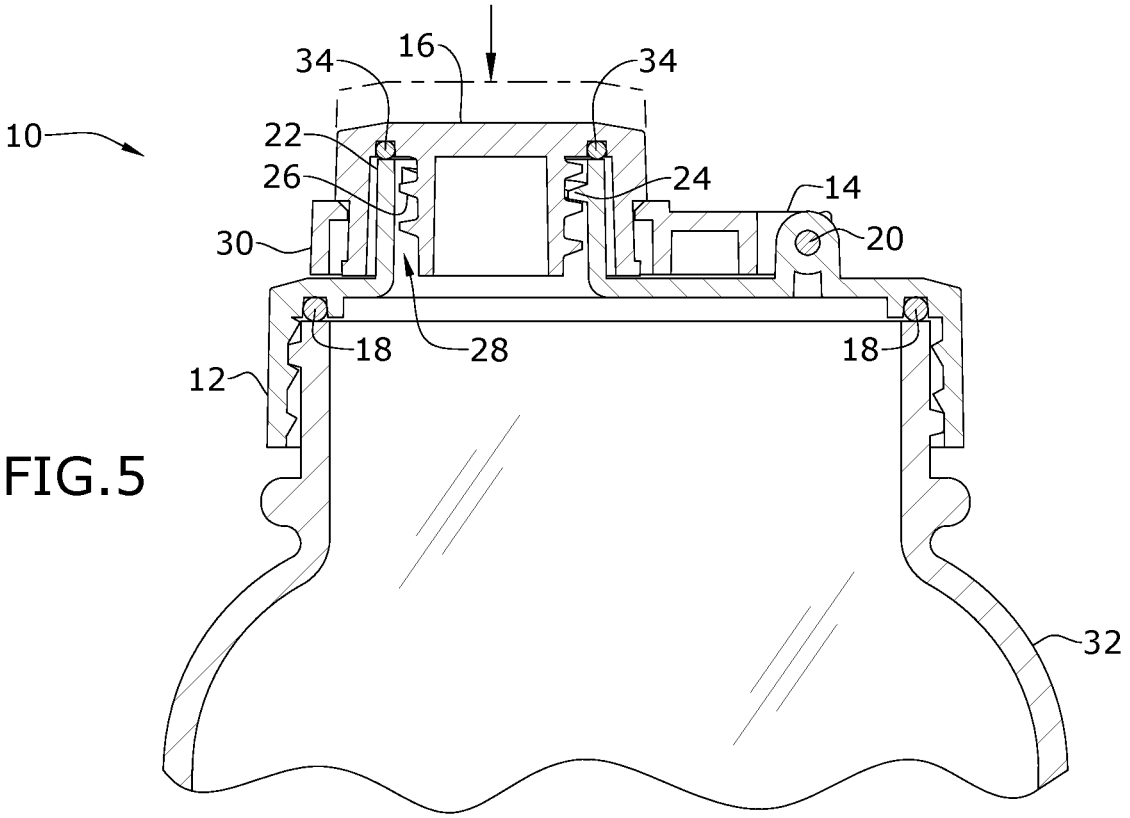
FIG. 5 is a section view of one embodiment of the present disclosure.

To help prevent leaks and create a more secure seal, the pourable jar lid 10 may include a lid gasket 18, such as an O-ring, positioned within the lid body 12 proximate to the body threads and a cap gasket 34 positioned within the pour spout cap 16. As shown in FIG. 5, when the cap 16 is fully tightened onto the pour spout 22, a top surface of the pour spout 22 may press against the cap gasket 34, creating the more secure seal. Similarly, when the lid body 12 is fully tightened onto the jar 32, a top surface of the neck of the jar 32 may press against the lid gasket 18, creating the more secure seal.

The lid 10 may also include multiple design features, such as textured outer surfaces on both the lid body 12 and the cap 16, as shown in the Figures. The lid 10 may also comprise a designated logo area for affixing, printing, or otherwise marking a desired logo thereon. Moreover, the lid 10 of the present disclosure may be made of any suitable or desired materials, such as plastic, metal (like stainless steel), and FDA approved food grade seals.

To use the lid 10 of the present disclosure, the lid body 12 may be engaged with a neck on a jar 32 by simply screwing the lid body 12 onto the neck, preferably until the top of the neck contacts and presses against the lid gasket 18. To seal the cap 16 onto the lid body 12, the cap extension may be inserted into the pour spout 22 and the cap 16 may be rotated, causing the cap threads 26 to engage with the spout threads 24, preferably until the top of the pour spout 22 contacts and presses against the cap gasket 34. In embodiments, this full closure of the cap 16 onto the pour spout 22 may require two full turns of the cap 16 within the pour spout 22.

To open the seal to access contents within the jar 32 without removing the lid body 12, the cap 16 may be rotated the opposite directed that it was rotated to seal the cap 16 to the pour spout 22. The arm 30 may then be opened 180°, as shown in FIG. 3. The pin 20 may provide some resistance to keep the arm 30 open with respect to the lid body 12. A user may then drink directly from the pour spout 22 or pour the contents of the jar 32 into another container through the pour spout 22, wherein the thread gap 36 may provide for cleaner pouring.

The above-described embodiments of the invention are presented for purposes of illustration and not of limitation. While these embodiments of the invention have been described with reference to numerous specific details, one of ordinary skill in the art will recognize that the invention can be embodied in other specific forms without departing from the spirit of the invention. Thus, one of ordinary skill in the art would understand that the invention is not to be limited by the foregoing illustrative details, but rather is to be defined by the appended claims.

What is claimed is:

1. A pourable jar lid designed to removably engage with a jar, the pourable far lid comprising:

a lid body having a top surface and a lid lip extending away from the top surface, the lid lip having interior body threads thereon, wherein the interior body threads are designed to removably engage with threads on a neck of the jar;

a pour spout extending upward from the top surface of the lid body, the pour spout comprising a raised wall defining a channel extending through the lid body, wherein an inner surface of pour spout comprises spout threads; and a pour spout cap hingeably attached to the top surface of the lid body, the pour spout cap comprising cap threads designed to removably engage with the spout threads, wherein:

the pour spout cap comprises a cap extension protruding from a bottom surface thereof;

the cap extension is sized to fit within the pour spout;

the cap threads are continuous along a circumference of an exterior surface of the cap extension;

the spout threads do not extend around an entire inner surface of the pour spout cap, thus defining a thread gap in the spout threads; and the thread gap extends along an entire height of the spout threads.

2. The pourable jar lid of claim 1, wherein the cap extension is concentrically positioned on the bottom surface of the pour spout cap and spaced from an inner surface of the cap, thus defining a spout cavity within the cap.

3. The pourable jar lid of claim 1, wherein the pour spout cap is operatively attached to a hinge on the top surface of the lid body.

4. The pourable jar lid of claim 3, further comprising an arm hingeably attached to the top surface of the lid body, wherein:

the pour spout cap is attached to an end of the arm distal from the hinge.

5. The pourable jar lid of claim 4, the hinge comprises:

a pin channel on the top surface of the lid body;

a pair of channel tabs on an end of the arm distal from the pour spout cap, wherein the pair of channel tabs are spaced apart such that the pin channel is positioned therebetween; and a hinge pin extending through the pair of channel tabs and the pin channel.

6. The pourable jar lid of claim 1, further comprising:

a lid gasket positioned within the lid body proximate to the body threads; and a cap gasket positioned within the pour spout cap.

* * * * *